US005632658A

United States Patent [19]

Chen et al.

[11] Patent Number: 5,632,658

[45] Date of Patent: May 27, 1997

[54] TRACTOR PODDED PROPULSOR FOR SURFACE SHIPS

[75] Inventors: Benjamin Y.-H. Chen; Carol L. Tseng, both of Potomac, Md.

[73] Assignee: The United States of America as represented by the Secretary of the Navy, Washington, D.C.

[21] Appl. No.: 651,024

[22] Filed: May 21, 1996

[51] Int. Cl.[6] ..... B63H 1/14

[52] U.S. Cl. ..... 440/49; 114/65 R

[58] Field of Search ..... 440/49, 53, 58, 440/59, 60, 79, 81, 63, 75; 114/65 R

[56] References Cited

U.S. PATENT DOCUMENTS

| | | | |
|---|---|---|---|
| 3,094,967 | 6/1963 | Willis, Jr. | 440/58 |
| 5,417,597 | 5/1995 | Levedahl | 440/6 |

OTHER PUBLICATIONS

Chen, Benjamin Y.-H. and Carol L. Tseng, "A Contrarotating Propeller Design for a High Speed Patrol Boat with Pod Propulsion," Proceedings of the Third International Conference on Fast Sea Transportation, vol. 2, (Sep. 1995), pp. 1003–1014.

*Primary Examiner*—Jesus D. Sotelo
*Attorney, Agent, or Firm*—Gary G. Borda

[57] ABSTRACT

In accordance with one embodiment of the present invention a surface ship having at least one tractor podded propulsor is provided. The vessel having a tractor podded propulsor system comprises a hull means and at least one tractor podded propulsor unit attached to the aft section of the hull means. The at least one tractor podded propulsor unit comprises an axisymmetric pod having a longitudinal centerline associated therewith, at least one propeller mounted for rotation to a forward end of the pod, and a substantially vertically aligned streamlined strut connected at a top end to the aft section of the hull means and connected at a bottom end to the pod. The pod has a forward end and a tapered aft end. Mounted within the pod is at least one rotatably mounted propeller shaft that extends forward of the pod forward end, shaft seals, thrust bearings, and power means functioning to rotate the at least one propeller shaft. The tractor podded propulsor produces lower resistance and higher cavitation inception speeds than prior art open shafts and struts systems.

14 Claims, 4 Drawing Sheets

TRACTOR PODDED PROPULSOR FOR SURFACE SHIPS

STATEMENT OF GOVERNMENT RIGHTS

The invention described herein may be manufactured and used by or for the Government of the United States of America for governmental purposes without the payment of any royalties thereon or therefor.

BACKGROUND OF THE INVENTION

1. Field of the Invention

The present invention relates generally to propulsors for surface ships and, more particularly, to a tractor podded propulsor unit for surface ships having contrarotating propellers mounted at the forward end of a streamlined pod that is aligned with the local incoming flow.

2. Brief Description of Related Art

A critical operating problem associated with surface ships, particularly high speed vehicles, is the existence of propeller blade cavitation. Operated below the free surface, a propeller will develop vortex cavitation and surface cavitation on the blade above a certain critical speed. Cavitation inception occurs when the local pressure falls to or below the vapor pressure of the surrounding fluid. Above the critical cavitation inception speed, serious fundamental flow changes occur that lead to undesirable variations in hydrodynamic and acoustic characteristics and possible damage to blade structure. Specifically, rudder cavitation induces unsteady hydrodynamic forces, vibration, and erosion resulting in noise, thrust breakdown, and blade erosion, all of which are detrimental to ship performance.

Conventional, single rotation propulsors mounted on inclined, strut supported shafts are the typical propulsion systems found on present surface ships. By mounting propellers on inclined shafts, the propeller experiences inflow at a nominal flow angle generally equal to the difference between the inclined shaft angle and the aft buttock lines. Moreover, because the shaft and strut are forward of the propeller, they induce nonuniform inflow into the propeller. This inclined, nonuniform flow results in a blade angle of attack variations that contribute to early blade cavitation.

Consequently, there is a need to provide a propulsor that reduces the detrimental effects of cavitation. More particularly, it would be desirable to provide a propulsor that reduces nonuniformities in the inflow. A more uniform inflow would result in the propeller blade section experiencing a nearly constant angle of attack which would improve cavitation performance by increasing cavitation inception speed.

SUMMARY OF THE INVENTION

It is accordingly an object of this invention to provide an improved propulsor having higher cavitation inception speed and thus improved hydrodynamic and acoustic performances.

It is a further object to provide a propulsor having a uniform inflow into the propeller.

It is a still further object to provide quieter ship operation, reduced cavitation erosion, and reduced vibration.

In accordance with one embodiment of the present invention, the objects and advantages are accomplished by a tractor podded propulsor unit for a surface ship. The tractor podded propulsor unit comprises an axisymmetric pod having a longitudinal centerline associated therewith, at least one propeller mounted for rotation to a forward end of the pod, and a substantially vertically aligned streamlined strut connected at a bottom end to the pod. The pod has a forward end and a tapered aft end. Mounted within the pod is at least one rotatably mounted propeller shaft that extends forward of the pod forward end, shaft seals, thrust bearings, and power means functioning to rotate the at least one propeller shaft.

In accordance with a further embodiment of the present invention a surface ship having at least one tractor podded propulsor is provided. The vessel having a tractor podded propulsor system comprises a hull means having a bow and a stern and forward, central and aft sections therebetween, and at least one tractor podded propulsor unit attached to the aft section. The at least one tractor podded propulsor unit comprises an axisymmetric pod having a longitudinal centerline associated therewith, at least one propeller mounted for rotation to a forward end of the pod, and a substantially vertically aligned streamlined strut connected at a top end to the aft section of the hull means and connected at a bottom end to the pod.

In accordance with the embodiments disclosed above, the axisymmetric pod has a maximum diameter associated therewith and the combination of the axisymmetric pod and the at least one propeller have a total length associated therewith such that a ratio of the total length to the maximum diameter is between about 5 and 10. Preferably, the pod and strut are substantially aligned with the direction of local flow into the propulsor unit.

In a preferred embodiment, the at least one propeller comprise contrarotating propellers including a forward propeller and an aft propeller, the at least one propeller shaft comprise contrarotating propeller shafts, and the power means comprise an electric motor and a contrarotating reduction gear. The aft propeller has a diameter less than or equal to about 85% of a diameter of the forward propeller. The forward and aft propellers are located relative to each other such that the axial spacing between the longitudinal (fore-aft) centerplane of the forward propeller and the longitudinal centerplane of the aft propeller is equal to between about 20% and about 30% of the forward propeller diameter. In the preferred embodiment the aft propeller comprises a central axisymmetric aft hub having an axis of rotation and a plurality of circumferentially spaced apart aft blades extending radially therefrom and the forward propeller comprises a central axisymmetric forward hub having an axis of rotation and a plurality of circumferentially spaced apart forward blades extending radially therefrom. The aft hub has a diameter at its aft end substantially equal to a diameter of the forward end of the pod. The forward hub has a diameter at its aft end substantially equal to the diameter of the forward end of the aft hub and has a tapered forward end. Generally, there are an odd number of forward blades and an odd number of aft blades, the number of aft blades being less than the number of forward blades. Additionally, the number of forward blades and the chordlengths of the forward blades are determined to ensure that the blade section lift coefficient of the forward propeller is less than about 0.5, and the number of aft blades and the chordlengths of the aft blades are determined to ensure that the blade section lift coefficient of the aft propeller is less than about 0.5.

In alternative embodiments of the present invention the strut may include therein steering means operative to rotate the pod relative to the strut about a substantially vertical axis perpendicular to the longitudinal centerline of the pod.

BRIEF DESCRIPTION OF THE DRAWINGS

The foregoing objects and other advantages of the present invention will be more fully understood by reference to the following description taken in conjunction with the accompanying drawings wherein like reference numerals refer to like or corresponding element throughout and wherein.

DETAILED DESCRIPTION OF THE PREFERRED EMBODIMENT

Certain aspects of the present invention are discussed in co-owned U.S. Pat. No. 5,417,597, herein incorporated by reference.

Figure 1:
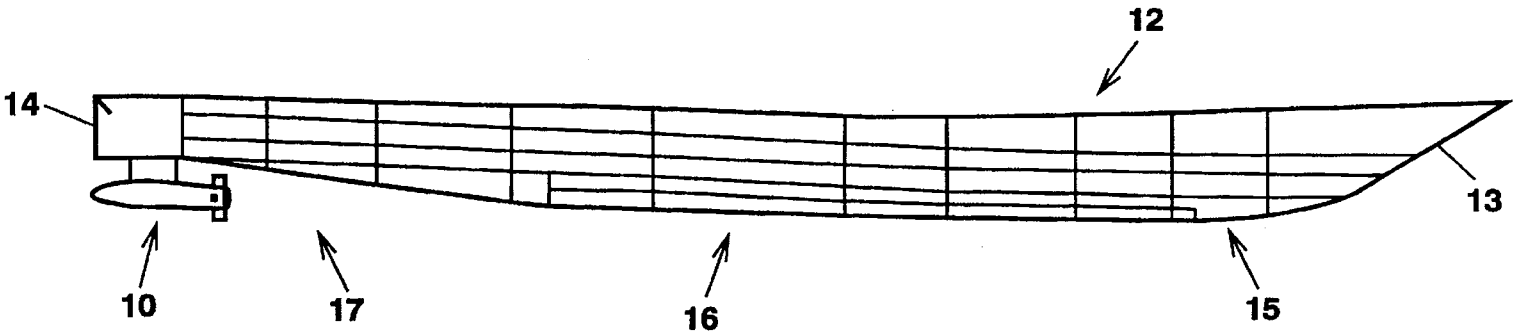
FIG. 1 is a side view of the present invention showing the tractor podded propulsor mounted to the aft section of a vessel.
Figure 2:
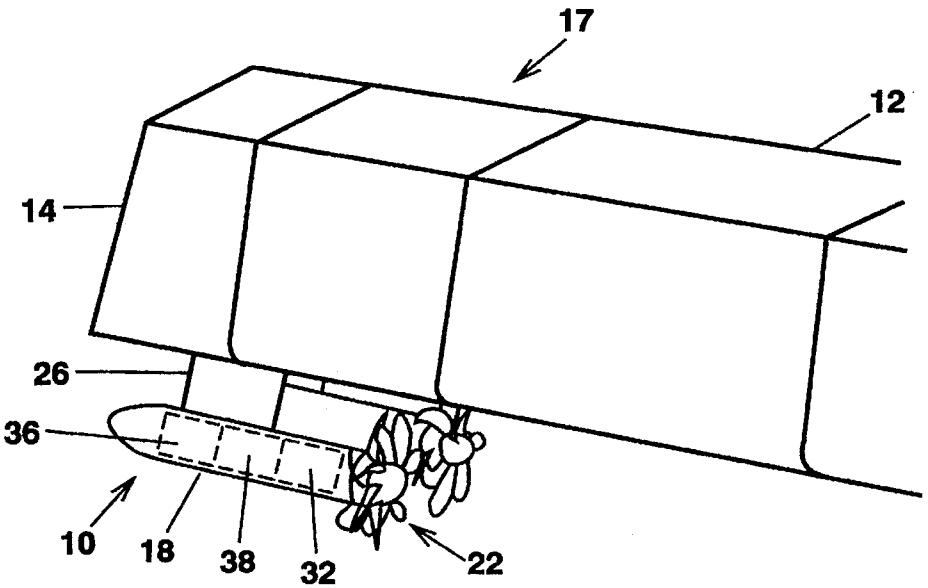
FIG. 2 is an isometric view of a preferred embodiment of the present invention.
Figure 3:
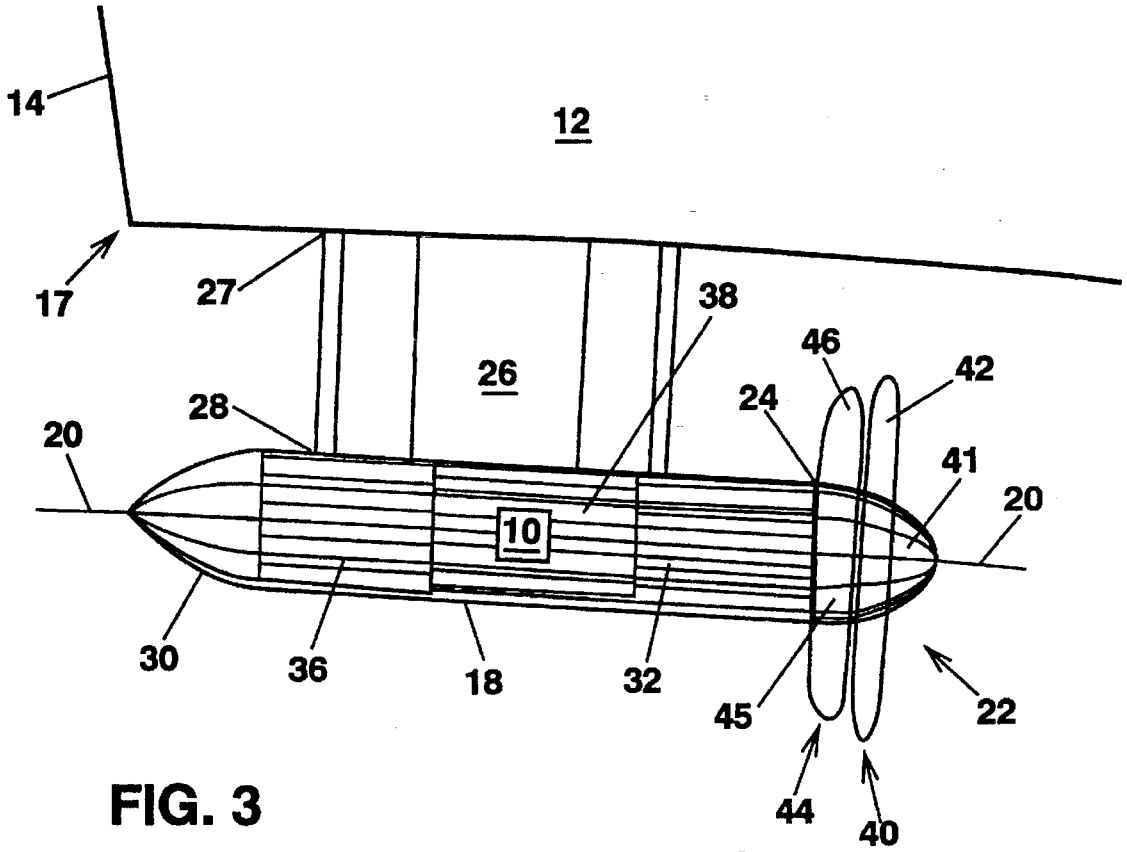
FIG. 3 is a side view of a preferred embodiment of the present invention showing the aft section of a vessel with the tractor podded propulsor mounted thereto.

Referring now to the drawings, and particularly to FIGS. 1 through 5, tractor podded propulsor 10 for a surface ship in accordance with the present is shown. In FIGS. 1 through 3, tractor podded propulsor 10 is shown mounted to a marine vessel that includes hull means 12. Hull means 12 may be a monohull, a planing or semi-planing craft, or any other marine vessel suitable for use with the present invention. Hull means 12 includes bow 13 and stern 14 having forward section 15, central section 16 and aft section 17 therebetween. The outlines of hull means 12 indicate how tractor podded propulsor 10 is located and oriented when mounted to aft section 17 of hull means 12. Aft section 17 is generally that portion of hull means 12 adjacent stern 14 and extending forward of stern 14 about one third of the vessel length measured at the waterline. The present invention may include one or more propulsors 10 mounted to the vessel. The number of propulsors 10 varies according to the propulsion requirements of the vessel.

Figure 5:
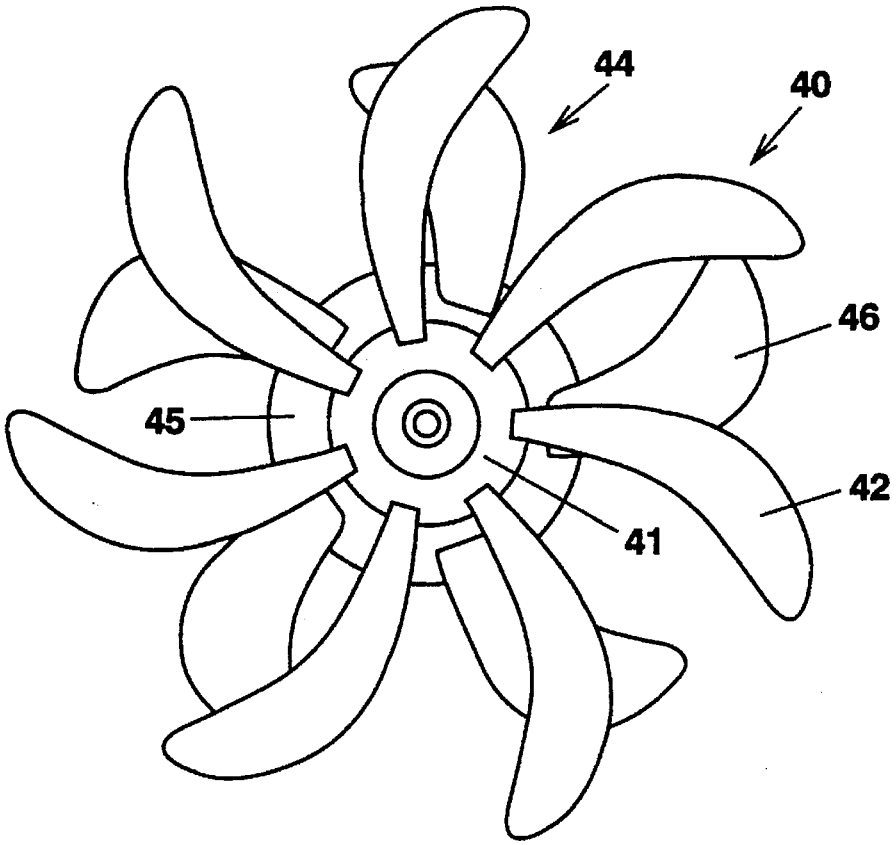
FIG. 5 is an end view of an exemplary embodiment of the present invention.

Referring to FIGS. 2 and 5, tractor podded propulsor 10 comprises axisymmetric pod 18 having a longitudinal centerline 20 associated therewith, at least one propeller 22 mounted for rotation to forward end 24 of pod 18, and a substantially vertically aligned streamlined strut 26 connected at a top end 27 to the aft section 17 of the hull means 12 and connected at a bottom end 28 to pod 18. Pod 18 has an open forward end 24 and a tapered aft end 30. Pod 18 forward of tapered aft end 30 is preferably cylindrical. One or more pods 18 are aligned with the water flow around the after-end of hull means 12 to provide substantially uniform axial flow into propellers 22 during straight-ahead operation. Such pods produce less than half the resistance of prior art open shafts and struts.

Tractor podded propulsor 10 may be either fixedly or rotatably attached to aft section 17 of hull means 12. If fixedly mounted to hull means 12, tractor podded propulsor 10 functions to propel hull means 12 while steering means, such as rudders mounted aft of propulsor 10, provide directional control. If rotatably mounted to hull means 12, tractor podded propulsor 10 functions to both propel and steer hull means 12. Steering during major maneuvers is preferably accomplished by rotating pod 18 using steering means operative to rotate the pod relative to the strut about a substantially vertical axis perpendicular to pod longitudinal centerline 20, for example, an electric motor and high-reduction-ratio gear system mounted within strut 26 or hull means 12. If two or more propulsors 10 are employed, pods 18 are mounted such that the end of each pod 18 aft of the axis of rotation is short enough not to interfere with adjacent pods during rotation.

Each pod 18 has mounted therein at least one propeller shaft, which extends forward of pod forward end 24, and associated shaft seals and thrust bearings (represented schematically as 32), at least one propeller 22 mounted on propeller shaft 32, and power means for rotating shaft 32 and propeller 22. Power means preferably comprises electric motor 36 and reduction gear 38. Bearings may be of any of the well known water lubricated or sealed type annular bearings generally used in rotating machinery. Suitable shafts, shaft seals, bearings and power sources are well know in the art (and are, thus, represented schematically) and are not intended as limitations on the present invention. An engine (not shown) within hull means 12 is operatively connected with electric motor 36 to provide electric propulsion (and steering) power to tractor podded propulsor 10.

Axisymmetric pod 18 has a maximum diameter associated therewith and the combined pod 18 and propeller(s) 22 have a total length associated therewith such that a ratio of the total length to the maximum diameter is between about 5 and 10. However, to minimize resistance, pod 18 is preferably of the minimum diameter and length consistent with motor diameter and acoustic requirements (i.e., to accommodate acoustic mounts and acoustic insulation).

In a preferred embodiment, propeller 22 comprises contrarotating propellers (including a forward propeller 40 and an aft propeller 44), the at least one propeller shaft comprises contrarotating propeller shafts, and the power means comprise an electric motor and a contrarotating reduction gear. Lightly loaded, CR tractor propellers, facing directly into the undisturbed flow stream outside the hull boundary layer, provide high efficiency and reduced cavitation. Contrarotating propellers with seven blades forward and five blades aft minimize both tip cavitation and acoustic signature. In addition, CR propellers sharply decrease the wake signature by avoiding major wake vortex that brings cooler subsurface water to the surface. Any suitably sized prior art CR reduction gear system is compatible with the present invention. However, a ring-ring bicoupled contrarotating epicyclic reduction gear is preferred. Ring-ring bicoupled contrarotating epicyclic reduction gear is disclosed in co-owned U.S. patent application Ser. No. 08/527,988, herein incorporated by reference. Although CR propellers are preferred, pre-swirl, post-swirl and co-swirl propulsors, conventional fixed pitch propellers, and controllable, reversible pitch propellers, and their associated shafts, shaft seals, bearings and power means, are also within the scope of the present invention.

In order that aft propeller 44 be located fully within the wake of forward propeller 40 and that any tip vortices generated by forward propeller blades 42 do not impinge on aft propeller blades 46, the diameter of aft propeller 44 is restricted to being less than or equal to about 85% of the diameter of forward propeller 40. Additionally, forward propeller 40 and aft propeller 44 are located relative to each other such that the axial spacing between longitudinal centerplane 43 (i.e., fore-aft vertically oriented centerplane) of forward propeller 40 and longitudinal centerplane 47 of aft propeller 44 is equal to between about 20% and about 30% of the diameter of forward propeller 40, preferably approximately 25%.

In the preferred embodiment, aft propeller 44 comprises a central axisymmetric aft hub 45 having an axis of rotation and a plurality of circumferentially spaced apart aft blades 46 extending radially therefrom. Forward propeller 40 comprises a central axisymmetric forward hub 41 having an axis of rotation and a plurality of circumferentially spaced apart forward blades 42 extending radially therefrom. Each of blades 42, 46 have a leading edge and a trailing edge that defines their chordlengths, and a root and a tip that defines their spans. Blade chordlength may vary with span. Each of blades 42, 46 are attached at their roots to their respective hub 41, 45. Each of blades 42, 46 have streamlined cross-sections, that preferably comprise airfoil or hydrofoils shapes, such as for example NACA sections.

Hubs 41, 45 have an axis of rotation 20 and are adapted for being mounted for rotation with rotating shafts 32. Hubs 41, 45 are shaped to provide a smooth transition into each other and into pod 18. Thus, aft hub 45 has a diameter at its aft end substantially equal to a diameter of forward end 24 of pod 18. Forward hub 41 has a diameter at its aft end substantially equal to the diameter of the forward end of the aft hub 45 and has a tapered forward end.

Forward and aft propellers 40, 44 are designed to minimized cavitation while producing a required thrust at a predetermined operating point (i.e., at a predetermined vehicle forward speed and propeller rotational speed). Forward propeller 40 is designed for a specific predetermined hub shape, forward propeller diameter and thrust ratio between forward and aft propellers. During the design, the number of blades, chordlength distribution (chordlength as a function of forward propeller radius), thickness distribution (thickness as a function of forward propeller radius), skew distribution (skew angle as a function of forward propeller radius), pitch distribution (pitch angle as a function of forward propeller radius), camber distribution (camber as a function of forward propeller radius), and circulation distribution (circulation as a function of forward propeller radius) that produce the required operational thrust at the operating point and minimize cavitation are determined. These values define the final design geometry of forward propeller 40.

Once the axial spacing between forward propeller 40 and aft propeller 44 is set, the shape of aft propeller hub 45 is known. Aft propeller 44 is designed to have a specific aft propeller diameter, number of blades, chordlength distribution (chordlength as a function of aft propeller radius), thickness distribution (thickness as a function of aft propeller radius), skew distribution (skew angle as a function of aft propeller radius), pitch distribution (pitch angle as a function of aft propeller radius), camber distribution (camber as a function of aft propeller radius), and circulation distribution (circulation as a function of aft propeller radius) that produce the required operational thrust at the operating point and minimize cavitation (and preferably produce a torque substantially equal and opposite to the torque produced by forward propeller 40). These values define the final design geometry of the aft propeller 45. Blades 42 of forward propeller 40 and blades 46 of aft propeller 44 are pitched oppositely with respect to each other in order to produce torque in opposite directions.

Flow separation is a potential problem in the propulsor design. By keeping the blade section lift coefficient ($C_L$) low, the possibility of flow separation can be minimized. Consequently, the preferred embodiment of the present invention is restricted to $C_L \leqq 0.5$ for both the forward and aft propellers. The definition of lift coefficient is $C_L = L/0.5\rho Vr^2 c$ where: L is the lift$=\rho Vr\Gamma$; $\rho$ is the fluid density; Vr is resultant velocity over the blade; c is blade chord length; and $\Gamma$ is the circulation. Thus, the number of forward and aft blades and their respective chordlength, camber distributions, and circulations are determined to ensure that the blade section lift coefficients of forward propeller and aft propellers are less than about 0.5. Forward propeller 40 and aft propeller 44 generally both have an odd number of blades. Moreover, the number of aft propeller blades is generally less than the number of forward propeller blades.

In designing contrarotating propellers for tractor podded propulsor 10, three fundamental principles need to be satisfied: conservation of momentum, mass, and circulation. The principles of momentum, mass, and circulation conservation are well known in the art, so only a cursory review will be presented here. Momentum conservation requires that the net force generated by the contrarotating propellers be balanced by the vehicle barehull drag and the drag due to propulsor-hull interactions. Mass conservation determines the circulation distribution of the aft propeller once the circulation distribution of the forward propeller is specified. Circulation conservation determines the magnitude of the aft propeller circulation once the magnitude of the forward propeller circulation is specified. The magnitude of the aft propeller circulation is calculated such that total circulation is conserved.

Design methods for designing propellers are well known in the art. A preferred design procedure is presented below and is more fully described in Chen, Benjamin Y.-H. and Tseng Carol L., "A Contrarotating Propeller Design for a High Speed Patrol Boat with Pod Propulsion," Proceedings of the Third International Conference on Fast Sea Transportation, Vol. 2, pp. 1003–1014 (September 1995), incorporated herein by reference. The design procedure consists of three phases: specification of operating conditions, design, and analysis. During the first phase, the design requirements and the wake survey data (measurement of axial, radial and tangential flow velocities in the propulsor plane in the absence of the propulsor) are provided. The effects of the vehicle hull on the flow and the hull-propulsor interaction are traditionally represented by the nominal wake (wake in the propulsor plane in the absence of a propulsor) and two interaction coefficients: the thrust deduction factor and the wake fraction. These input values can be obtained from a model wake survey and resistance and propulsion experiments with a stock propulsor. Alternatively, these values can be obtained using any of many well known numerical computer programs for computing airfoil or propeller performance and predicting free-field velocity distributions. Such programs employ panel methods to model the vehicle, propeller and incompressible potential flow theory to compute velocity distributions, and boundary layer methods to determine vehicle resistance and propulsor inflow boundary layer profiles.

The design phase consists of three stages: preliminary, intermediate and final design stages. During the preliminary design phase, the effects of varying a limited number of design parameters (e.g., diameter, angular velocity, number of blades and radial distribution of loading) are investigated. The preliminary design stage uses lifting-line theory to perform a parametric study to determine optimum forward and aft propeller diameters, rotation speeds, and number of blades. Circulation distributions for the forward and aft propellers are also determined. Propulsive efficiency is calculated and considered in choosing the preliminary design values for the forward and aft propellers.

In the intermediate design stage, cavitation inception and blade or vane strength are the major factors in determining thickness, chordlengths, and blade loading distributions for the forward and aft propellers. Consideration is also given to strength requirements and propulsive efficiency which are effected by these parameters. Stress calculations for the forward and aft propellers are performed using a simple beam theory.

Blade surface cavitation and tip vortex cavitation calculations are performed for both forward and aft propellers. The cavitation inception prediction method for the forward propeller is the same as for conventional single rotation propellers since there is no other component forward of the forward propeller. The cavitation inception prediction method for the aft propeller is a quasi-steady prediction method. The method consists of two steps: inflow calculation and cavitation calculations. The method is considered quasi-steady because induced velocities from the forward propeller are held steady for one cavitation inception calculation on the aft propeller, then the forward propeller is rotated $\delta\theta$ and another cavitation inception calculation on the aft propeller is performed. More details on this procedure are provided in the above referenced report by Chen and Tseng.

The final design stage employs lifting-surface theory to incorporate three dimensional flow-field effects into the design. The effects of the forward and aft propeller hubs are represented. During this stage, pitch and camber distributions are determined using a contrarotating lifting-surface program.

During the analysis phase, steady and unsteady forces and moments are calculated using inverse lifting-surface programs. To determine the resultant steady thrust, torque and efficiency of the propulsor under design (operating point) and off design conditions, a vortex lattice method including hub effects is employed. The design is complete when unsteady shaft forces and moments are below predetermined design requirements.

Once the geometric parameters (chordlength, thickness, skew, rake, pitch and camber distributions) of the final design are determined, the X, Y and Z coordinates of the blade surfaces can be determined using, for example, any of numerous well known computer aided design/computer aided manufacturing (CAD/CAM) software packages. The data can then be input into, for example, a numerical cutting or milling machine to produce the finished product.

EXAMPLE

In an exemplary, preferred embodiment of the present invention, a tractor podded contrarotating propulsor for a high speed patrol boat sought to maximize propulsive efficiency while minimizing propulsor noise due to cavitation and unsteady forces. During the design process, a design that would deliver substantially cavitation free operation at the operating point was desired. The design of an exemplary tractor podded propulsor for a high speed patrol boat is more fully described in the above referenced paper by Chen and Tseng.

The high speed patrol boat is a round bilge planing hull craft with a length of 154 ft and a displacement of 260 tons. The existing hull has a diesel/gas turbine driving a twin screw, open shaft and strut mounted propulsion system. A controllable pitch propeller was mounted on each strut supported propeller shaft.

By employing the present invention, the existing shaft and strut system was replaced by a twin podded system powered by electric motors located within each pod. Each pod/propeller combination was 20 ft in length with a length to maximum diameter ratio of 7. Compared to the existing shaft and strut system, the podded system of the present invention significantly reduces total resistance at the design speed.

Several design constraints were placed on the design. The contrarotating propellers were designed at the operating point for the high speed patrol boat. Boat speed was 20 knots (10.3 m/sec). Thrust loading coefficient, $C_{TH}$, was 0.280. Forward propeller diameter was 7.56 ft and rotational speed was 117 rpm. The forward propeller had 7 blades and the aft propeller had 5 blades.

Boat resistance and the mean velocity profile for flow at the forward and aft propeller planes (for powering calculation), the circumferential velocity distribution at the forward and aft propeller planes (for blade surface cavitation analysis), and the interaction coefficients (thrust deduction factor of 0.885 and wake fraction of 1.00) were determined.

Design parameters were chosen based on a parametric study. The aft propeller diameter was determined through mass conservation. To ensure that the aft propeller operates inside the tip vortices of the forward propeller, the final aft propeller diameter (85% of the forward propeller diameter, i.e., 6.43 ft) was chosen to be slightly smaller than the preliminary diameter calculated using mass conservation. Axial spacing between the forward and aft propellers was equal to 25% of the forward propeller diameter (i.e., 1.89 ft.)

Figure 6:
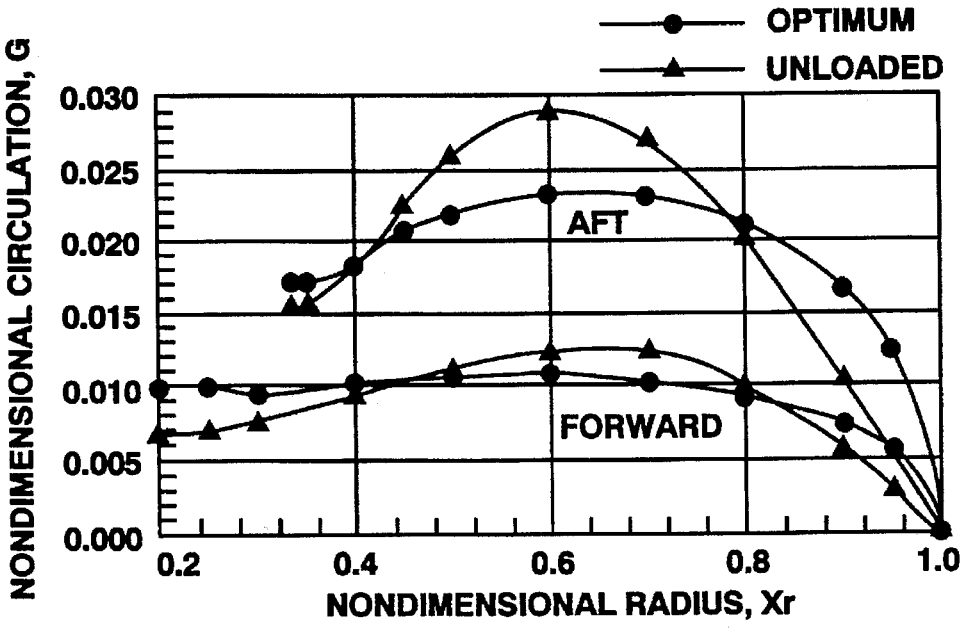
FIG. 6 shows the optimum and unloaded circulation distributions for forward and aft propellers of an exemplary embodiment of the present invention.

During preliminary design, lifting-line calculations were used to determine the circulation distribution of the forward and aft propellers. The optimum and unloaded circulation distributions for the forward and aft propellers are shown in FIG. 6. The root and tip of both the forward and aft propellers were unloaded and loading was shifted inboard. The advantages of unloading the blade root and tip include delaying blade hub and tip vortex cavitation inception and reducing the tendency toward cavitation erosion near blade root and tip. The following guidelines for unloading the root were employed: (1) the net circulation at the root is zero to minimize hub vortex strength, and (2) the slope of the circulation at the root is near zero to minimize trailing edge vortex sheet cavitation. To minimize the possibility of flow separation, circulation distribution was constrained to keep the values of blade section lift coefficients of the forward and aft propellers were restricted to being less than or equal to 0.5. The same guidelines were used in determining the circulation distribution of both propellers.

The thickness and chordlength distributions were determined from strength analysis and cavitation performance predictions. When the final thickness and chordlength distributions were determined during the intermediate design phase, the lifting-line calculations were repeated with the final geometry. A non-linear skew distribution with 25 degree tip was determined skew for the forward and aft propellers to minimize unsteady forces. Zero total rake was used.

During the intermediate design, a thickness distribution for the forward and aft propellers was chosen based on strength and cavitation considerations. The strength requirement at full power condition was not to exceed 12,500 psi maximum stress for nickel aluminum bronze material. Stress calculation for the forward and aft propellers were performed using a simple beam theory. Blade surface cavitation calculations for the forward propeller was straight forward because there were no components in front of the forward propeller. The quasi-steady analysis method described earlier was used for the aft propeller.

To minimize hub vortex strength, the circulation at the roots of the forward and aft propeller blades was determined to be equal in magnitude and opposite in direction. The spanwise gradient of circulation at the root was chosen to be substantially equal to zero for each propeller to inhibit trailing edge vortex sheet formation.

Figure 4:
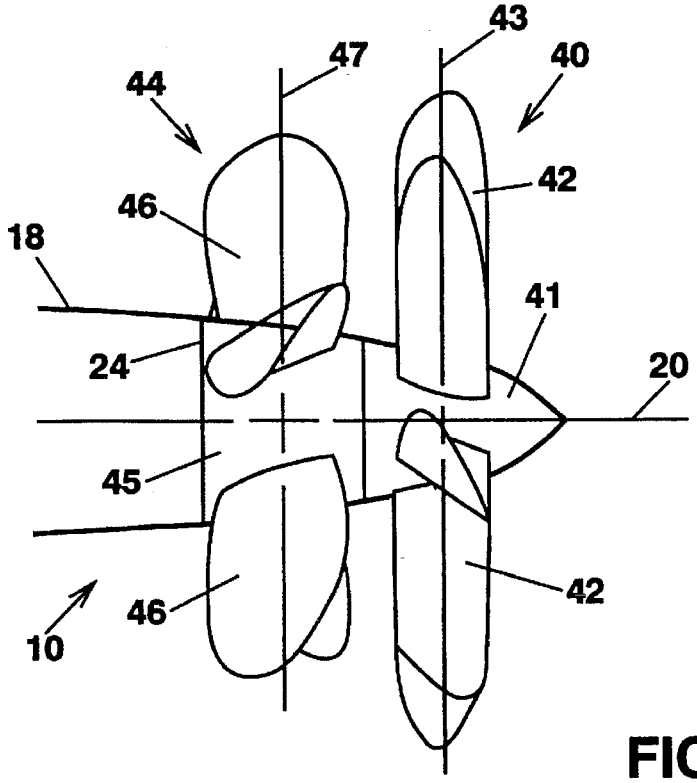
FIG. 4 is a partial side view of an exemplary embodiment of the present invention.
Figure 7:
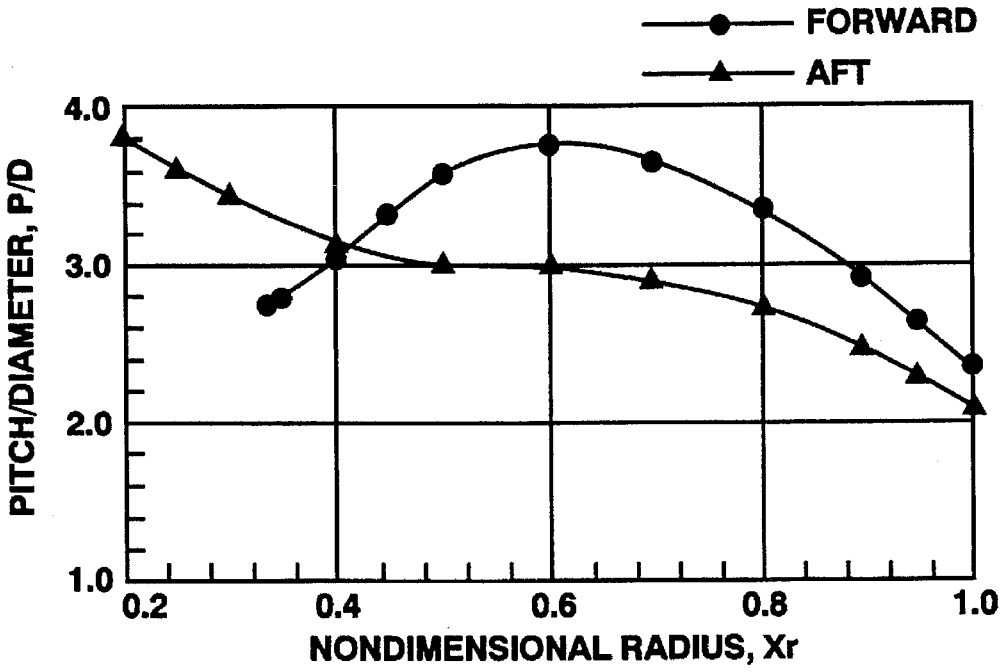
FIG. 7 shows the pitch distributions for forward and aft propellers of an exemplary embodiment of the present invention.
Figure 8:
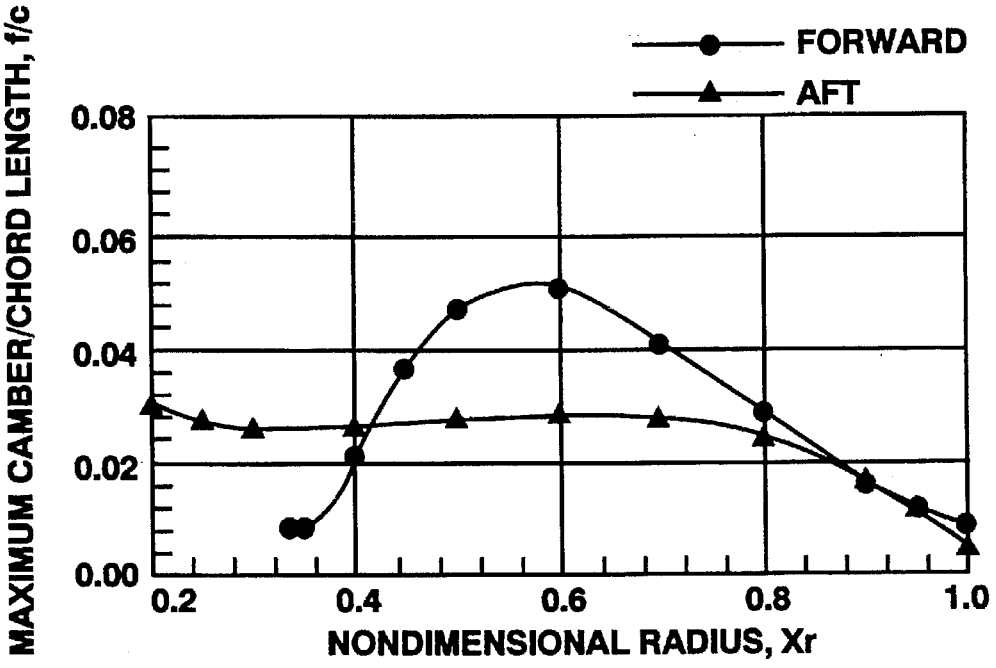
FIG. 8 shows the camber distributions for forward and aft propellers of an exemplary embodiment of the present invention.

During the final design, final pitch and camber distributions were determined using lifting-surface theory and included hub effects. The induced velocities on the aft propeller were calculated by lifting-line calculations. A 0.80 meanline chordwise loading distribution and a modified NACA 66 thickness form were used. FIGS. 7 and 8 show the final faired pitch and camber distributions for the forward and aft propellers. FIGS. 4 and 5 represent the present tractor podded CR propeller design.

Model self-propulsion experiments and cavitation inception experiments were performed on the tractor podded contrarotating propulsors of the present invention and the existing shaft and strut supported single rotation propulsors. The present invention reduced power consumption and increased cavitation inception speed when compared to the existing propulsion system without degrading overall performance. Compared to the existing shaft and strut supported controllable pitch propeller system, the present invention reduced power consumption by 28% and increased cavitation inception speed by 7 knots.

The advantages of the present invention are numerous. The present invention provides a propulsor unit that is located outside the hull wake and that does not include shafts and struts forward of the propellers. Thus the tractor podded propulsor eliminates nonuniformities in the propulsor inflow resulting in propulsor blade sections having nearly constant angles of attack and greatly improved cavitation performance. Moreover, the present invention provides significant reduction in power consumption and increase in cavitation inception speed. In addition, the invention provides improved acoustic performance.

The present invention and many of its attendant advantages will be understood from the foregoing description and it will be apparent to those skilled in the art to which the invention relates that various modifications may be made in the form, construction and arrangement of the elements of the invention described herein without departing from the spirit and scope of the invention or sacrificing all of its material advantages. The forms of the present invention herein described are not intended to be limiting but are merely preferred or exemplary embodiments thereof.

What is claimed is:

1. A tractor podded propulsor unit for a surface ship comprising:

an axisymmetric pod having a longitudinal centerline associated therewith, said pod having a forward end and a tapered aft end, said pod having mounted therein contrarotating propeller shafts that extends forward of said forward end, shaft seals, thrust bearings, and power means functioning to rotate said contrarotating propeller shafts, said power means including an electric motor and a contrarotating reduction gear;

contrarotating propellers including a forward propeller and an aft propeller mounted to forward ends of said contrarotating propeller shafts wherein said aft propeller has a diameter less than or equal to about 85% of a diameter of said forward propeller; and a substantially vertically aligned streamlined strut connected at a bottom end to said pod.

2. A tractor podded propulsor unit as in claim 1 wherein said axisymmetric pod has a maximum diameter associated therewith and wherein said axisymmetric pod and said at least one propeller have a total length associated therewith such that a ratio of said total length to said maximum diameter is between about 5 and 10.

3. A tractor plodder propulsor unit as in claim 1 wherein a longitudinal spacing between said forward propeller and said aft propeller is equal to between about 20% and about 30% of said forward propeller diameter.

4. A tractor podded propulsor unit as in claim 1 wherein:

said aft propeller comprises a central axisymmetric aft hub having an axis of rotation and a plurality of circumferentially spaced apart aft blades extending radially therefrom, said aft hub having a diameter at an aft end substantially equal to a diameter of said forward end of said pod and having a diameter at a forward end, said aft blades having aft chordlengths associated therewith; and said forward propeller comprises a central axisymmetric forward hub having an axis of rotation and a plurality of circumferentially spaced apart forward blades extending radially therefrom, said forward hub having a diameter at an aft end substantially equal to said diameter of said forward end of said aft hub and having a tapered forward end, said blades having forward chordlengths associated therewith.

5. A tractor podded propulsor unit as in claim 4 wherein said plurality of forward blades is an odd number of blades, said number of forward blades and said forward chordlengths being determined to ensure that a blade section lift coefficient of said forward propeller is less than about 0.5, and wherein said plurality of aft blades is an odd number of blades, said number of aft blades being less than said number of forward blades, said number of aft blades and said aft chordlengths being determined to ensure that a blade section lift coefficient of said aft propeller is less than about 0.5.

6. A tractor podded propulsor unit as in claim 1 wherein said pod and said strut are substantially aligned with a local inflow direction.

7. A tractor podded propulsor unit as in claim 1 wherein said strut includes therein steering means operative to rotate said pod relative to said strut about a substantially vertical axis perpendicular to said longitudinal centerline of said pod.

8. A vessel having a tractor podded propulsor system, comprising:

a hull means having a bow and a stem said bow and stem having forward, central and aft sections therebetween; and an axisymmetric pod having a longitudinal centerline associated therewith, said pod having a forward end and a tapered aft end, said pod having mounted therein contrarotating propeller shafts that extends forward of said pod forward end, shaft seals, thrust bearings, and power means functioning to rotate said contrarotating propeller shafts, said power means including an electric motor and a contrarotating reduction gear;

contrarotating propellers including a forward propeller and an aft propeller mounted to forward ends of said contrarotating propeller shafts wherein said aft propeller has a diameter less than or equal to about 85% of a diameter of said forward propeller; and a substantially vertically aligned streamlined strut connected at a top end to said aft section of said hull means and connected at a bottom end to said pod.

9. A vessel as in claim 8 wherein said axisymmetric pod has a maximum diameter associated therewith and wherein said axisymmetric pod and said at least one propeller have a total length associated therewith such that a ratio of said total length to said maximum diameter is between about 5 and 10.

10. A vessel as in claim 8 wherein a longitudinal spacing between said forward propeller and said aft propeller is equal to between about 20% and about 30% of said forward propeller diameter.

11. A vessel as in claim 8 wherein:

said aft propeller comprises a central axisymmetric aft hub having an axis of rotation and a plurality of circumferentially spaced apart aft blades extending radially therefrom, said aft hub having a diameter at an aft end substantially equal to a diameter of said forward end of said pod and having a diameter at a forward end, said aft blades having aft chordlengths associated therewith; and said forward propeller comprises a central axisymmetric forward hub having an axis of rotation and a plurality of circumferentially spaced apart forward blades extending radially therefrom, said forward hub having a diameter at an aft end substantially equal to said diameter of said forward end of said aft hub and having a tapered forward end, said blades having forward chordlengths associated therewith.

12. A vessel as in claim 11 wherein said plurality of forward blades is an odd number of blades, said number of forward blades and said forward chordlengths being determined to ensure that a blade section lift coefficient of said forward propeller is less than about 0.5, and wherein said plurality of aft blades is an odd number of vanes, said number of aft blades being less than said number of forward blades, said number of aft blades and said aft chordlengths being determined to ensure that a blade section lift coefficient of said aft propeller is less than about 0.5.

13. A vessel as in claim 8 wherein said pod and said strut are substantially aligned with a local inflow direction.

14. A vessel as in claim 8 wherein said strut includes therein steering means operative to rotate said pod relative to said strut about a substantially vertical axis perpendicular to said longitudinal centerline of said pod.

* * * * *